US008712289B2

(12) United States Patent
Kawahara et al.

(10) Patent No.: US 8,712,289 B2
(45) Date of Patent: Apr. 29, 2014

(54) LIGHT IRRADIATION ELEMENT, IMAGE FORMING STRUCTURE, AND IMAGE FORMING APPARATUS

(75) Inventors: Ichirou Kawahara, Saitama (JP); Masaki Suto, Saitama (JP); Hiroshi Shokaku, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/494,476

(22) Filed: Jun. 12, 2012

(65) Prior Publication Data

US 2012/0251183 A1 Oct. 4, 2012

Related U.S. Application Data

(62) Division of application No. 12/135,689, filed on Jun. 9, 2008, now Pat. No. 8,224,207.

(30) Foreign Application Priority Data

Oct. 12, 2007 (JP) ..... 2007-266436
Dec. 19, 2007 (JP) ..... 2007-327539
Mar. 24, 2008 (JP) ..... 2008-075075

(51) Int. Cl.
*G03G 21/00* (2006.01)
*G03G 15/04* (2006.01)
*G03G 15/00* (2006.01)

(52) U.S. Cl.
USPC ..... 399/128; 399/177; 399/207; 399/221

(58) Field of Classification Search
USPC ..... 399/128, 177, 207, 221
See application file for complete search history.

(56) References Cited

U.S. PATENT DOCUMENTS

| | | | |
|---|---|---|---|
| 4,561,761 | A | 12/1985 | Fox |
| 4,963,933 | A | 10/1990 | Brownlee |
| 5,243,506 | A | 9/1993 | Whitehead |
| 5,339,382 | A | 8/1994 | Whitehead |
| 5,661,839 | A | 8/1997 | Whitehead |
| 5,850,585 | A | 12/1998 | Tsutsumi et al. |
| 6,031,958 | A | 2/2000 | McGaffigan |
| 6,160,948 | A | 12/2000 | McGaffigan |
| 6,337,946 | B1 | 1/2002 | McGaffigan |
| RE37,594 | E | 3/2002 | Whitehead |
| 6,520,655 | B2 | 2/2003 | Ohuchi |
| 6,738,588 | B2 | 5/2004 | Yokomori et al. |

(Continued)

FOREIGN PATENT DOCUMENTS

| | | | |
|---|---|---|---|
| CN | 1360234 | A | 7/2002 |
| CN | 1703636 | A | 11/2005 |

(Continued)

OTHER PUBLICATIONS

Australian Office Action dated Nov. 24, 2009 corresponding to Australian Patent Application No. 2008202701.

(Continued)

*Primary Examiner* — Joseph S Wong
(74) *Attorney, Agent, or Firm* — Sughrue Mion, PLLC

(57) ABSTRACT

A light irradiation element includes a cavity through which light passes and a translucent light conduit bordering the cavity, allowing light to pass therethrough and transmitting the light passed through the cavity, the light irradiation element being disposed along a longitudinal direction of an image bearing body on which an electrostatic latent image is formed and directing the light passed through the light conduit to irradiate the image bearing body.

10 Claims, 23 Drawing Sheets

(56) References Cited

U.S. PATENT DOCUMENTS

| | | | |
|---|---|---|---|
| 7,218,824 | B2 | 5/2007 | Franklin et al. |
| 2002/0081126 | A1 | 6/2002 | Yokomori et al. |
| 2002/0172530 | A1 | 11/2002 | Kido et al. |
| 2003/0007764 | A1 | 1/2003 | Hirota |
| 2006/0060751 | A1 | 3/2006 | Nishimura et al. |
| 2006/0109681 | A1 | 5/2006 | Kim et al. |
| 2008/0266902 | A1 | 10/2008 | Zheng |

FOREIGN PATENT DOCUMENTS

| | | | |
|---|---|---|---|
| CN | 1752871 | A | 3/2006 |
| CN | 201007745 | Y | 1/2008 |
| CN | 101295099 | A | 10/2008 |
| JP | 62-153701 | U | 9/1987 |
| JP | 63-068873 | A | 3/1988 |
| JP | 2-45573 | U | 3/1990 |
| JP | 2-75683 | U | 6/1990 |
| JP | 05-188225 | A | 7/1993 |
| JP | 6-507996 | A | 9/1994 |
| JP | 2675677 | B | 7/1997 |
| JP | 10-123897 | A | 5/1998 |
| JP | 10-133026 | A | 5/1998 |
| JP | 2000-090720 | A | 3/2000 |
| JP | 2001-155503 | A | 6/2001 |
| JP | 2001-202804 | A | 7/2001 |
| JP | 2002-044378 | A | 2/2002 |
| JP | 2002-512731 | A | 4/2002 |
| JP | 2002-189400 | A | 7/2002 |
| JP | 2002-250818 | A | 9/2002 |
| JP | 2002-278395 | A | 9/2002 |
| JP | 2003-295717 | A | 10/2003 |
| JP | 3652246 | B2 | 3/2005 |
| JP | 2005-275130 | A | 10/2005 |
| JP | 2006-024468 | A | 1/2006 |
| JP | 2006-113216 | A | 4/2006 |
| JP | 3850373 | B2 | 9/2006 |
| JP | 2007-200612 | A | 8/2007 |
| JP | 2008-198497 | A | 8/2008 |
| JP | 2009-217126 | A | 9/2009 |

OTHER PUBLICATIONS

Japanese Notification of Reasons for Refusal dated Nov. 7, 2012 issued in Japanese Patent Application No. 2008-075075.

Chinese Office Action issued in Chinese Application No. 201210113560.9 dated Feb. 8, 2014.

LIGHT IRRADIATION ELEMENT, IMAGE FORMING STRUCTURE, AND IMAGE FORMING APPARATUS

CROSS-REFERENCE TO RELATED APPLICATIONS

This application is a divisional of U.S. patent application Ser. No. 12/135,689, filed on Jun. 9, 2008, which is based on and claims priority under 35 USC 119 from Japanese Patent Application No. 2007-266436 filed Oct. 12, 2007, Japanese Patent Application No. 2007-327539 filed Dec. 19, 2007, and Japanese Patent Application No. 2008-075075 filed Mar. 24, 2008.

BACKGROUND

1. Technical Field

The present invention relates to a light irradiation element, an image forming structure, and an image forming apparatus.

2. Related Art

In an image forming apparatus of this type, an image bearing body is charged by a charging device, a latent image is formed by an optical projection device and is made visible by a development device, and a developer image thus formed on the image bearing body is transferred onto a paper sheet. After the transfer, electric charges on the image bearing body are removed by an optical charge-erasing device.

SUMMARY

According to an aspect of the invention, the invention resides in a light irradiation element including a cavity through which light passes and a translucent light conduit bordering the cavity, allowing light to pass therethrough and transmitting the light passed through the cavity, the light irradiation element being disposed along a longitudinal direction of an image bearing body on which an electrostatic latent image is formed and directing the light passed through the light conduit to irradiate the image bearing body.

BRIEF DESCRIPTION OF THE DRAWINGS

Exemplary embodiments of the present invention will be described in detail based on the following figures, wherein.

DETAILED DESCRIPTION

To begin with, a first exemplary embodiment of the invention is described.

Figure 1:
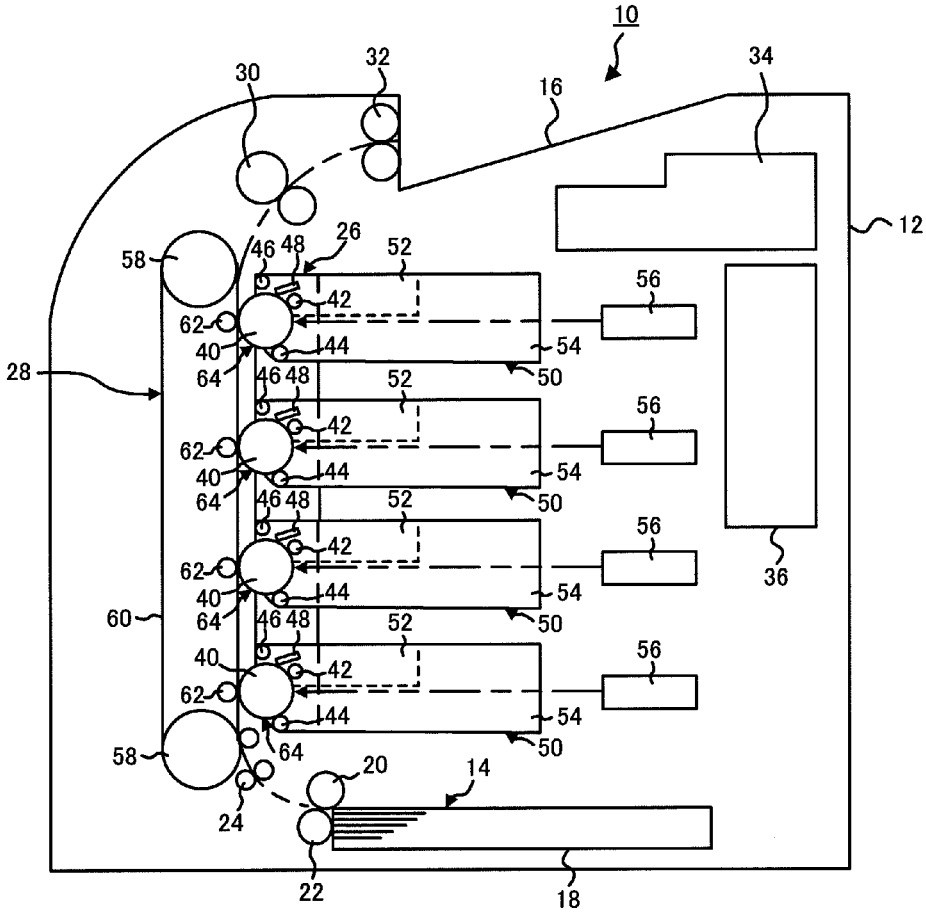
FIG. 1 depicts an image forming apparatus 10 in accordance with an exemplary embodiment of the invention.

FIG. 1 depicts an image forming apparatus 10 in accordance with an exemplary embodiment of the invention.

As shown in FIG. 1, the image forming apparatus 10 has an image forming apparatus main body 12. A paper feeder 14 is placed at the bottom of the image forming apparatus main body 12 and a paper collector 16 is formed at the top of the image forming apparatus main body 12.

The paper feeder 14 has a paper tray 18 and a lot of paper sheets are stacked in the paper tray 18. On the upper corner of one end of the paper tray 18, a feed roller 20 is placed and a retard roller 22 is positioned in abutting contact with the feed roller 20. From the paper stack in the paper tray 18, a top sheet is picked up by the feed roller 20 and separated from another and transported by cooperation of the feed roller 20 and the retard roller 22.

A paper sheet being transported from the paper tray 18 is once stopped by registration rollers 24 and, at a predetermined timing, further transported between an image bearing unit 26 which will be described later and a transfer unit 28. After passing through a fixing device 30, the sheet is ejected by eject rollers 32 to the paper collector 16.

In the image forming apparatus main body 12, the image bearing unit 26 installed removably from the image forming apparatus main body 12, the transfer unit 28, a power supply unit 34, toner boxes 50, optical projection devices 56, and a controller 36 are arranged. The controller 36 controls the components.

The image bearing unit 26 has, for example, four image forming subunits 64 (image forming structures). In each of the image forming subunits 64, an image bearing body 40 is rotatably supported. The image bearing body 40 bears an image that is transferred to a conveying belt 60 which will be described later or paper transported by the conveying belt 60. The image bearing body 40 is formed of, for example, a photoreceptor having a photosensitive layer. In the image forming subunit 64, around the image bearing body 40, the following are arranged: a charging device 42 with charging rollers for charging the image bearing body 40 with a given polarity, a development device 44 which develops an electrostatic latent image formed on the image bearing body by a developer, an optical charge-erasing device 46 (charge-erasing unit) which removes charges from the image bearing body 40 after transfer, and a cleaning device 48 which eliminates the remaining developer after the transfer of a developer image from the image bearing body 40.

The toner boxes 50 are connected laterally to the back side of the image bearing unit 26. Each toner box 50 is integrally formed of a toner feeder 54 and a toner collector 52. The toner feeder 54 is connected to the development device 44 and supplies toner to the development device 44. The toner collector 52 is connected to the cleaning device 48 and collects toner of each color. The toner boxes 50 are, for example, for magenta, yellow, cyan and black.

Each of the optical projection devices 56 is formed of a laser exposure device and located in a posterior direction to the image bearing unit 26 and in a corresponding position to each image bearing body 40. The optical projection device 56 irradiates the uniformly charged image bearing body 40 with laser to form a latent image.

The transfer unit 28 is located in front of the image bearing unit 26 and placed vertically facing the image bearing unit 26. In the transfer unit 28, the conveying belt 60 is suspended on two supporting rollers 58 installed in up and down positions. The conveying belt transports an image or paper. Transfer rollers 62 are disposed in abutting contact with the image bearing bodies 40 with the conveying belt 60 running between each transfer roller and each image bearing body.

Accordingly, after each of the image bearing bodies 40 is charged by the charging device 42, an electrostatic latent image is formed on the image bearing body by the optical projection device 56, and this image is made visible with toner by the development device 44. A toner image formed on each image bearing body 40 is transferred onto paper being transported by the conveying belt 60 in the transfer unit 28 and fixed onto the paper by the fixing device 30. After the transfer, charges on the image bearing body 40 are removed by the optical charge-erasing device 46.

Figure 2:
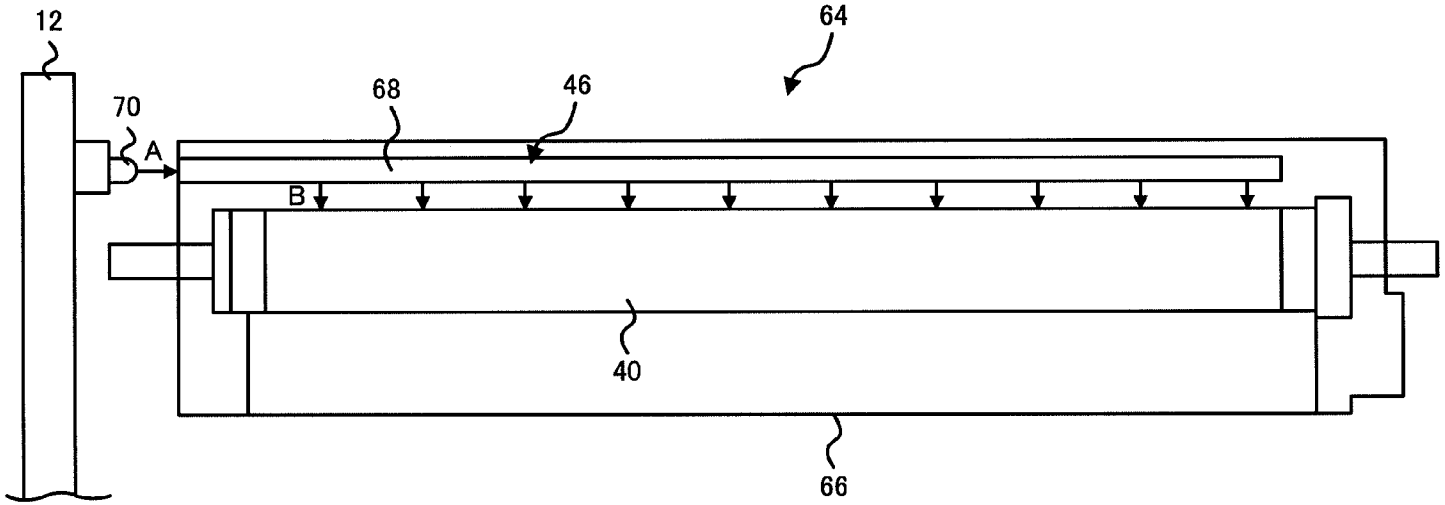
FIG. 2 depicts an image forming subunit 64, focusing on an image bearing body 40 and an optical charge-erasing device 46.

FIG. 2 depicts an image forming subunit 64, focusing on an image bearing body 40 and an optical charge-erasing device 46.

As shown in FIG. 2, the optical charge-erasing device 46 includes a light irradiation element 68 and a light emission member 70.

The light emission member 70 is a light source provided in the image forming apparatus main body 12 and it is, for example, an LED (Light Emitting Diode). The light emission member 70 is positioned in a line extending in a longitudinal direction of the light irradiation element 68. A distance between the light emission member 70 and the light irradiation element 68 is, for example, 1 to 3 mm. The light emission member 70 applies light to one end face of the light irradiation element 68 in the longitudinal direction, as indicated by arrow A.

The light irradiation element 68 is installed in an image forming subunit body 66 along the longitudinal direction of the image bearing body 40 rotatably supported in the image forming subunit body 66. The light irradiation element 68 uniformly irradiates the image bearing body 40 with light emitted from the light emission member 70, as indicated by arrow B, thereby removing charges from the image bearing body 40.

Figure 3:
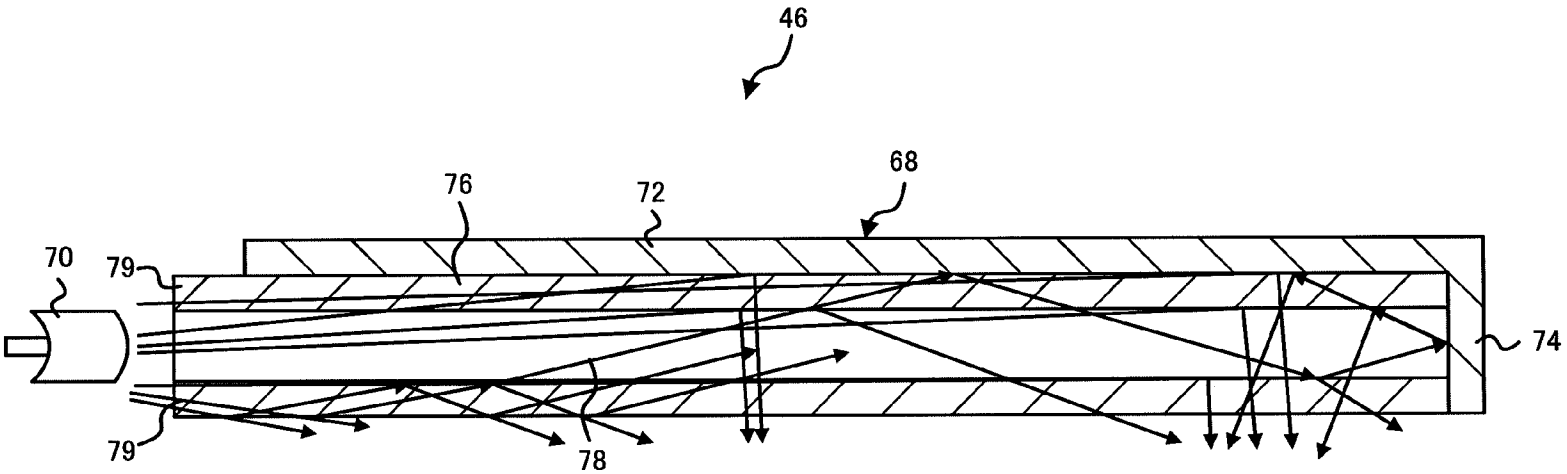
FIG. 3 depicts the optical charge-erasing device 46, focusing on the side cross section of a light irradiation element 68.

FIG. 3 depicts the optical charge-erasing device 46, focusing on the side cross section of the light irradiation element 68 of the present exemplary embodiment.

Figure 4:
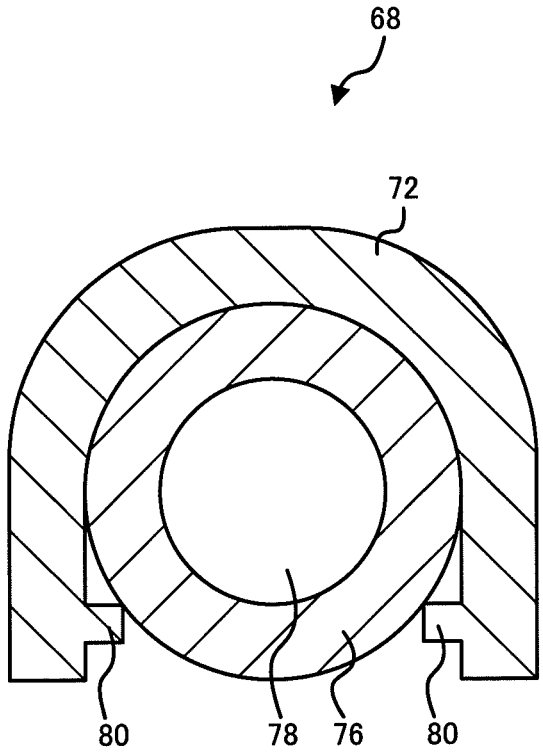
FIG. 4 shows the cross section of the light irradiation element 68 when viewed from a light emission member 70.

FIG. 4 shows the cross section of the light irradiation element 68 when viewed from the light emission member 70.

As shown in FIG. 3 and FIG. 4, the light irradiation element 68 includes a cavity 78 through which light passes, a translucent light conduit 76 bordering the cavity 78, and reflection member 72 for reflecting the light. The cavity 78, the light conduit 76, and the reflection member 72 are located along the longitudinal direction of the image bearing body 40. The cavity 78 terminates at one end at an opening 79 formed at one end of the light conduit 76 in the longitudinal direction. In other words, the cavity 78 is bordered by the opening 79 of the light conduit 76 at one end of the light conduit 76 in the longitudinal direction.

The light conduit 76 is hollow and has the opening 79 for light to enter, formed on the end face in the longitudinal direction. The light conduit 76 is made by extrusion molding from any of the following: e.g., acrylic resin, polycarbonate resin, polyethylene resin, and ABS resin. The inside diameter of the light conduit 76 is, for example, 3 mm and the outside diameter of the light conduit 76 is, for example, 5 mm. Here, the outside diameter of the light emission member 70 is preferably larger than the inside diameter of the light conduit 76; for example, 3 mm or more and preferably 5 mm.

Of the light conduit 76, the end face with the opening for light to enter is roughened. Roughness of the end face of the light conduit 76 is, for example, Rz=3 to 15 μm, preferably, Rz=15 μm or more.

The reflection member 72 is a sheath made from, for example, white resin and covers at least a part of the light conduit 76. More particularly, the reflection member 72 covers the light conduit 76 along the longitudinal direction, but uncovers a light incident section for incident light to enter the light conduit 76 and a side facing and closer to the image bearing body 40. The reflection member 72 further has a termination section 74 that covers the other end opposite to the end having the opening 79 for light to enter.

Accordingly, light emitted from the light emission member 70 passes through the cavity 78 or the inside of the light conduit 76 of the light irradiation element 68 and are reflected by at least one of the light conduit 76 and the reflection member 72, and irradiate the image bearing body 40.

Light energy loss when light passes through the cavity is smaller than that when light passes through the light conduit 76. Therefore, for the light passing through the cavity, attenuation in the light amount is suppressed as the light travels from the end near the light emission member 70 to the far end opposite to the light emission member 70. Thereby, it is easy to gain a sufficient amount of light for irradiating the image bearing body 40 even at a far point from the light emission member 70.

When the termination section 74 is provided on the opposite end of the light emission member 70, light is reflected by the termination section 74 and returns, with the result that reflection and transmission are repeated. This increases the amount of light irradiating the image bearing body 40 near the termination section 74.

Arrows shown in FIG. 3 schematizes light reflection or transmission occurring at an interfacial surface of either the light conduit 76 or the reflection member 72. These arrows do not exactly represent all light pathways in terms of incident angles, reflection angles, and refraction angles. Actually, there occur reflections or transmissions of countless light rays beyond those shown.

Figure 5:
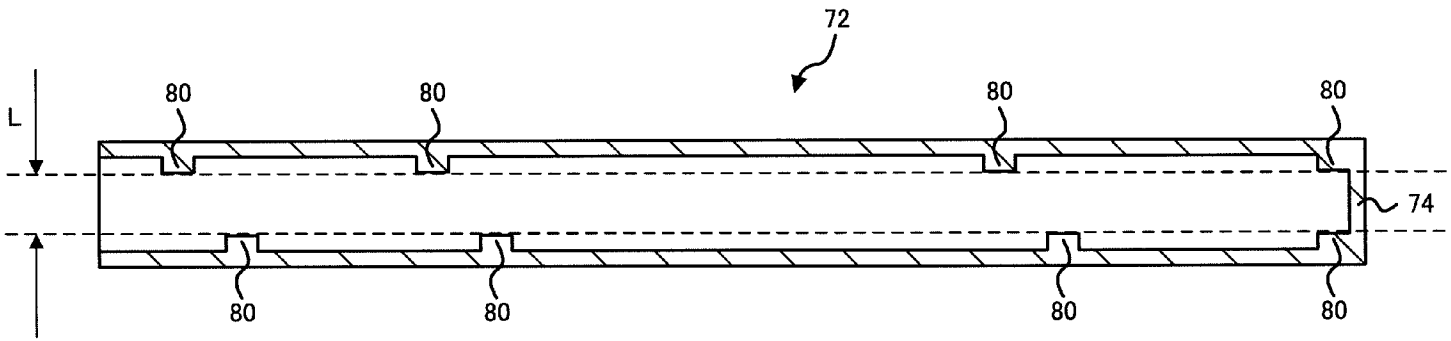
FIG. 5 depicts a reflection part 72 when viewed from the open side facing the image bearing body 40.

FIG. 5 depicts the reflection member 72 when viewed from the open side facing the image bearing body 40.

As shown in FIG. 5, the reflection member 72 has an open section facing the image bearing body 40 and protrusions 80 which may be formed in, for example, a protruding boss or convex shape. Plural protrusions 80 are provided on both sides of the open section. A distance L between a line connecting head levels of plural protrusions 80 provided on one side of the open section and a line connecting head levels of plural protrusions 80 provided on the other side of the open section is smaller than the diameter of the light conduit 76. Hence, when the light conduit 76 is fit in the reflection member 72, the protrusions 80 support the light conduit 76.

Instead of provision of the reflection member 72, alternative manners may be used in which the outside surface of the light conduit 76 is coated with a coating material having a color with a high reflectivity of light, such as white coating, and in which the outside surface of the light conduit 76 is covered with tape having a color with a high reflectivity of light, such as silver tape. Even in cases where these manners are used, the open section facing the image bearing body 40 remains unmasked.

Figure 6A:
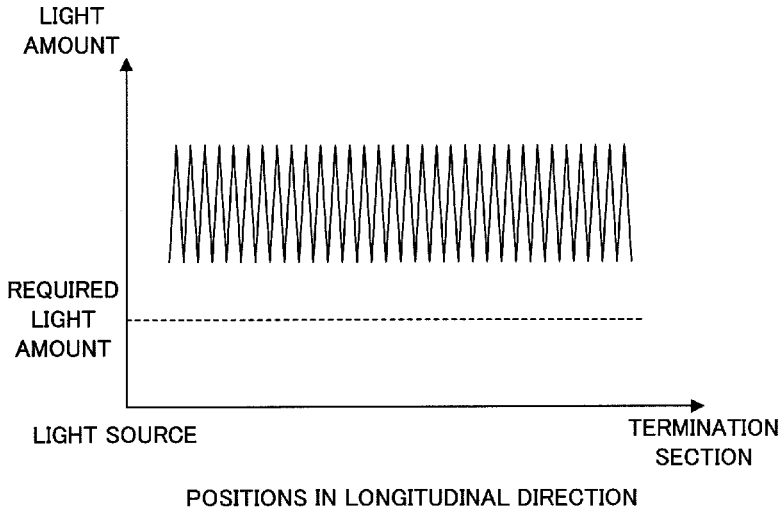
FIGS. 6A and 6B are graphs that represent a relationship between the amount of light irradiating the image bearing body 40 and the distance from the light emission member 70.
Figure 6B:
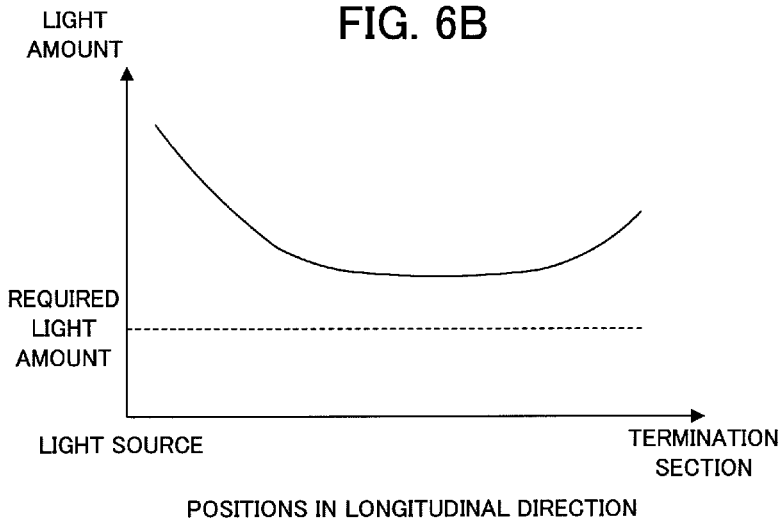

FIGS. 6A and 6B are graphs that represent a relationship between the amount of light irradiating the image bearing body 40 and the distance from the light emission member 70.

FIG. 6A shows a relationship between the amount of light irradiating the image bearing body 40 and the distance from the light emission member 70 in the case of light irradiation using a light guide unit with fine concavo-convex shapes formed in a direction intersecting the longitudinal direction. FIG. 6B shows a relationship between the amount of light irradiating the image bearing body 40 and the distance from the light emission member 70 in the case of using the light irradiation element 68 of the present exemplary embodiment.

When taking a broad view of the graph shown in FIG. 6A, attenuation in the light amount in the end near the light emission member 70, the far end (termination section 74) opposite to the light emission member 70, and the intermediate section is smaller than that observed in FIG. 6B. From a microscopic perspective, due to that fine concavo-convex shapes are formed in a direction intersecting the longitudinal direction of the light guide unit, alternate rise and fall of light irradiation appear more clearly than in FIG. 6B.

On the other hand, when taking a broad view of the graph shown in FIG. 6B, attenuation in the light amount from the end near the light emission member 70 to the termination section 74 is larger than that observed in FIG. 6A. Because light is reflected in the termination section 74, the light amount increases from the intermediate section to the termination section 74. From a microscopic perspective, alternate rise and fall of light irradiation do not appear, because fine concavo-convex shapes are not formed in the light conduit 76 in a direction intersecting the direction along the image bearing body 40. If fine notched grooves are formed in the light conduit 76 in the direction along the image bearing body 40, attenuation in the light amount from the end near the light emission member 70 to the termination section 74 will become more moderate in a broad perspective.

Supposing that the image bearing body 40 has deteriorated over time, a portion exposed to strong light irradiation and a portion exposed to weak light irradiation would have different amounts of charges on the image bearing body 40. In this case, if the light guide unit relevant to FIG. 6A is used, when an image with an intermediate image density such as a halftone image is printed, fine dark and light lines may appear as a defect visible to the human eye, because variations in charge amounts occur in close intervals. On the other hand, in the manner relevant to FIG. 6B, fine dark and light lines would not appear, showing no defect visible to the human eye, even if an image with an intermediate image density such as a halftone image is printed, because alternate rise and fall of light irradiation do not occur.

Moreover, the light guide unit relevant to FIG. 6A is generally molded by die machining, whereas the light conduit 76 relevant to FIG. 6B may be manufactured by simple, less costly processing such as drawing and extruding. Even if the light conduit 76 is manufactured by such processing, fine dark and light lines would not appear due to alternate rise and fall of light irradiation when the image bearing body 40 has deteriorated over time.

A degree of removing charges from the image bearing body 40 is determined by requirements of the image forming apparatus or the like in which the image bearing body 40 is used. Therefore, provided that at least a desired level of charge removal can be achieved, no special considerations need to be taken in terms of the degree and uniformity of the charge removal and details may be set appropriately. To achieve at least a desired level of charge removal in the longitudinal direction of the image bearing body 40, the size, light amount, light intensity, etc. of the light emission member 70, the length, thickness, shape, transparency, etc. of the light irradiation element 68, the sensitivity, running speed, etc. of the image bearing body 40, and the length, thickness, shape, transparency, etc. of the cavity 78, light conduit 76, and reflection member 72 constituting the light irradiation element 68 may be set respectively.

Then, the image forming apparatus 10 is further described with regard to second through eighth exemplary embodiments. In the second through eighth exemplary embodiments of the image forming apparatus 10, various forms of light irradiation elements 68 are used.

FIGS. 7A through 7F show cross sectional views of light irradiation elements 68 according to the second through eighth exemplary embodiments.

Figure 7A:
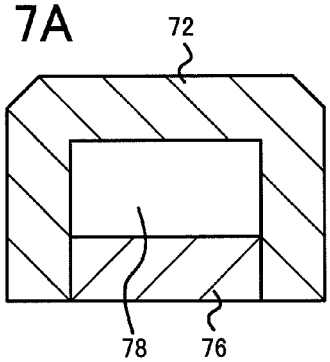
FIGS. 7A through 7G show cross sectional views of light irradiation elements 68 according to second through eighth exemplary embodiments.
Figure 7B:
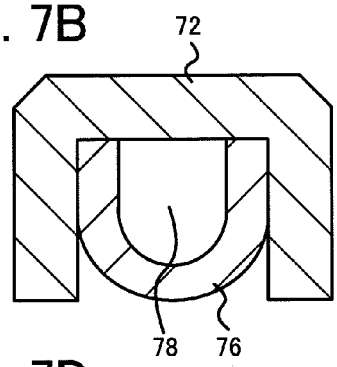
Figure 7C:
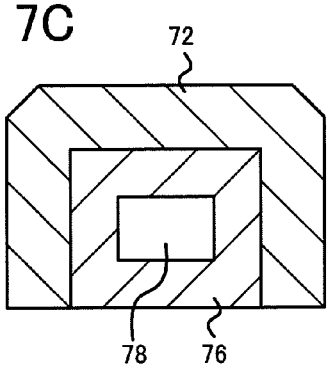

FIG. 7A shows a light irradiation element 68 in which the cavity 78 is defined by the light conduit 76 and the reflection member 72. FIG. 7B shows a light irradiation element 68 in which the cavity 78 is defined by the light conduit 76 having a nearly semicircular cross section and the reflection member 72. FIG. 7C shows a light irradiation element 68 in which the opening 79 of the light conduit 76 is rectangular.

Figure 7D:
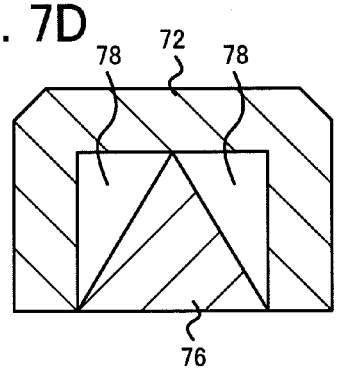
Figure 7E:
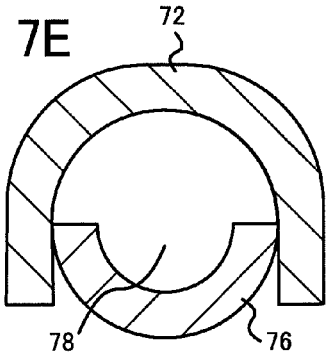
Figure 7F:
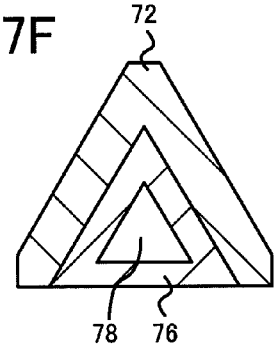
Figure 7G:
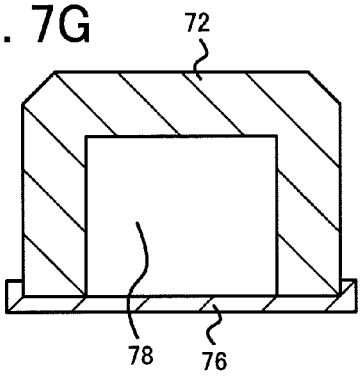

FIG. 7D shows a light irradiation element 68 in which plural cavities 78 are defined by the light conduit 76 and the reflection member 72. FIG. 7E shows a light irradiation element 68 in which the cavity 78 is defined by the light conduit 76 having a circular arc cross section and the reflection member 72. FIG. 7F shows a light irradiation element 68 in which the opening of the light conduit 76 is triangular. FIG. 7G shows a light irradiation element 68 in which the cavity 78 is defined by the light conduit 76 made of film such as, e.g., PET (Polyethylene Terephthalate) and the reflection member 72.

Next, the image forming apparatus 10 is described with regard to a ninth exemplary embodiment.

Figure 8:
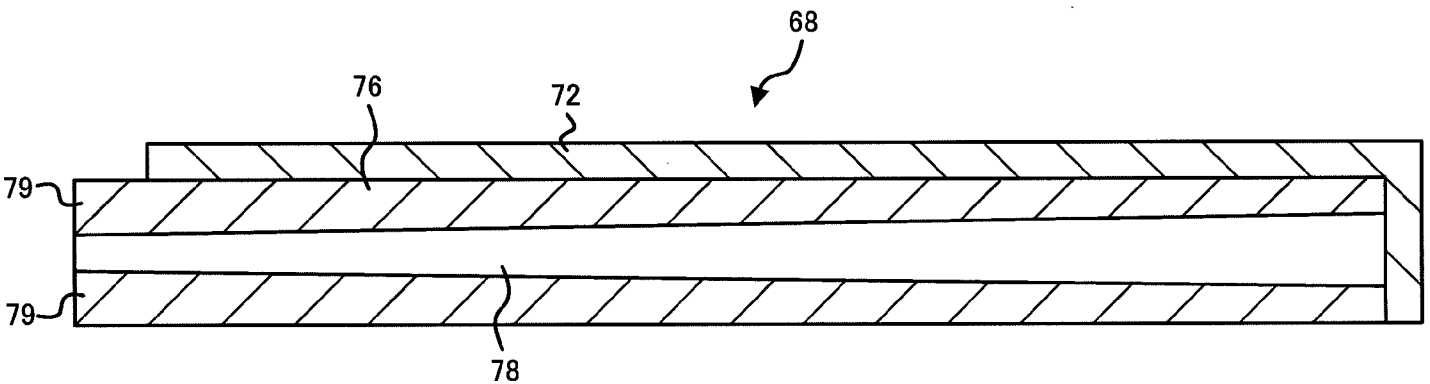
FIG. 8 shows a side cross section of the light irradiation element 68 according to a ninth exemplary embodiment.

FIG. 8 shows a side cross section of a light irradiation element 68 according to the ninth exemplary embodiment.

As shown in FIG. 8, in the light irradiation element 68 of the present exemplary embodiment, the light conduit 76 has a shape such that its inside diameter becomes larger as the distance from the opening 79 for light to enter goes farther along the longitudinal direction. That is, the inside area of the light conduit 76 changes depending on a position in the longitudinal direction and increases as the distance from the light incident end goes farther toward the opposite end.

Then, the image forming apparatus 10 is described with regard to a tenth exemplary embodiment.

Figure 9:
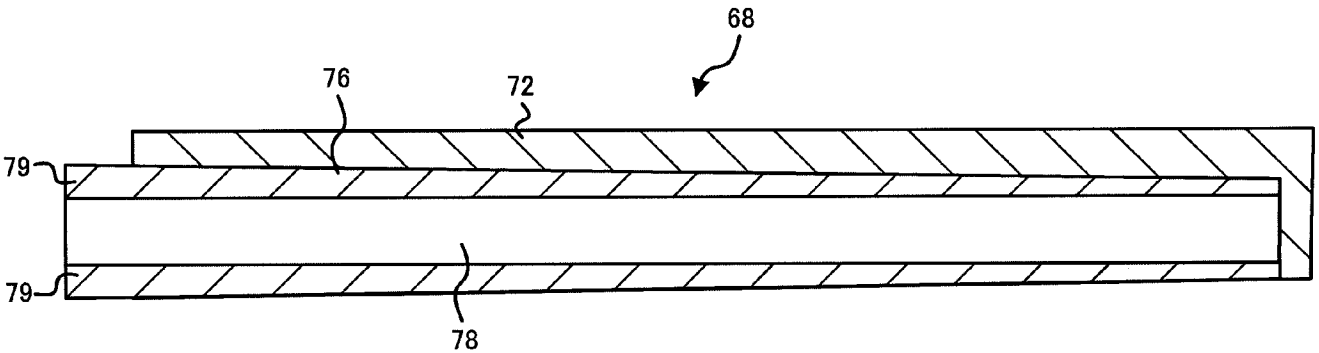
FIG. 9 shows a side cross section of the light irradiation element 68 according to a tenth exemplary embodiment.

FIG. 9 shows a side cross section of a light irradiation element 68 according to the tenth exemplary embodiment.

As shown in FIG. 9, in the light irradiation element 68 of the present exemplary embodiment, the light conduit 76 has a shape such that its outside diameter becomes smaller as the distance from the opening 79 for light to enter goes farther along the longitudinal direction. That is, the outside area of the light conduit 76 changes depending on a position in the longitudinal direction and decreases as the distance from the light incident end goes farther toward the opposite end.

Then, the image forming apparatus 10 is described with regard to an eleventh exemplary embodiment.

Figure 10:
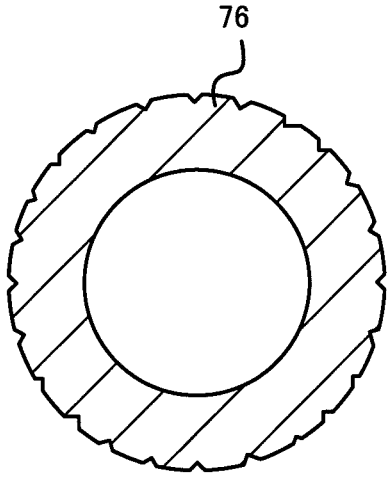
FIG. 10 shows a cross section of a light conduit 76 in the light irradiation element 68 according to an eleventh exemplary embodiment.

FIG. 10 shows a cross section of a light conduit 76 in a light irradiation element 68 according to the eleventh exemplary embodiment.

As shown in FIG. 10, in the light irradiation element 68 of the present exemplary embodiment, the outer circumference of the light conduit 76 is provided with plural flutes (grooves). The inner circumference of the light conduit 76 may be provided with such grooves. That is, the light conduit 76 has grooves formed in the longitudinal direction on one of its outer and inner circumferential surfaces.

Then, the image forming apparatus 10 is described with regard to a twelfth exemplary embodiment.

Figure 11:
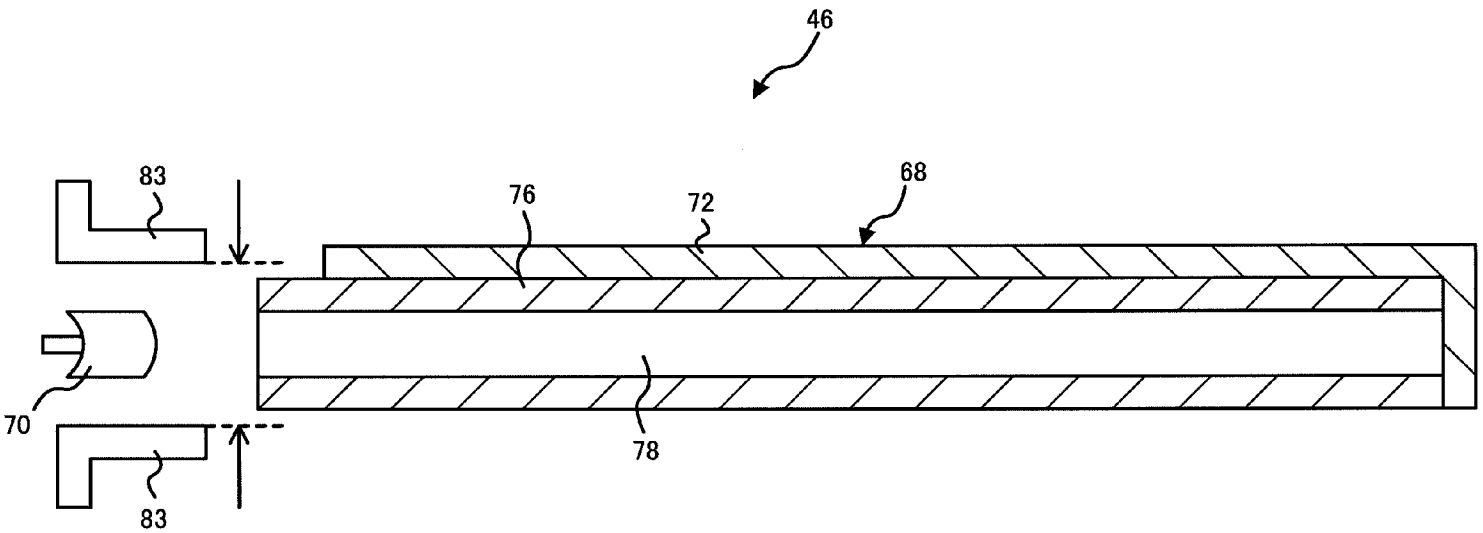
FIG. 11 depicts an optical charge-erasing device 46, focusing on the side cross section of the light irradiation element 68 according to a twelfth exemplary embodiment.

FIG. 11 depicts an optical charge-erasing device 46, focusing on the side cross section of a light irradiation element 68 according to the present exemplary embodiment.

As shown in FIG. 11, in the present exemplary embodiment, the light emission member 70 is covered with a shielding member 83 having an inside diameter larger than the outside diameter of the light conduit 76. The shielding member 83 extends from the light emission member 70 to at least a middle point of the gap between the light emission member 70 and the light conduit 76. The shielding member 83 may be a part of the image forming apparatus main body 12.

Then, the image forming apparatus 10 is described with regard to a thirteenth exemplary embodiment. In the thirteenth exemplary embodiment of the image forming apparatus 10, a light irradiation element 68 includes a light conduit 76 provided with convex spots for reflecting light.

Figure 12:
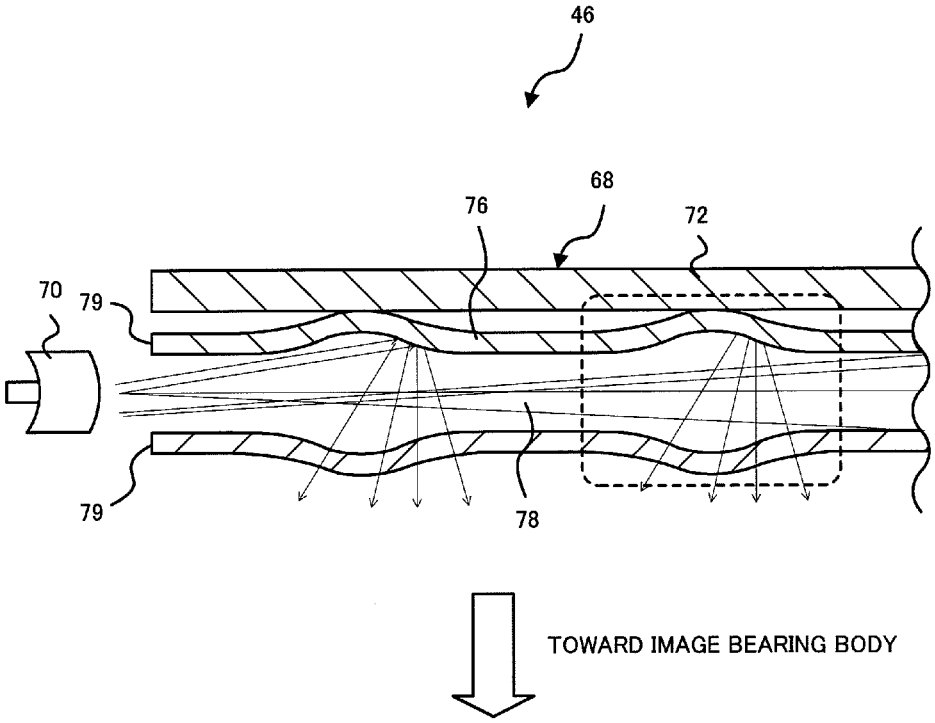
FIG. 12 depicts an optical charge-erasing device 46, focusing on the side cross section of the light irradiation element 68 according to a thirteenth exemplary embodiment.

FIG. 12 depicts an optical charge-erasing device 46, focusing on the side cross section of a light irradiation element 68 according to the thirteenth exemplary embodiment.

Figure 13:
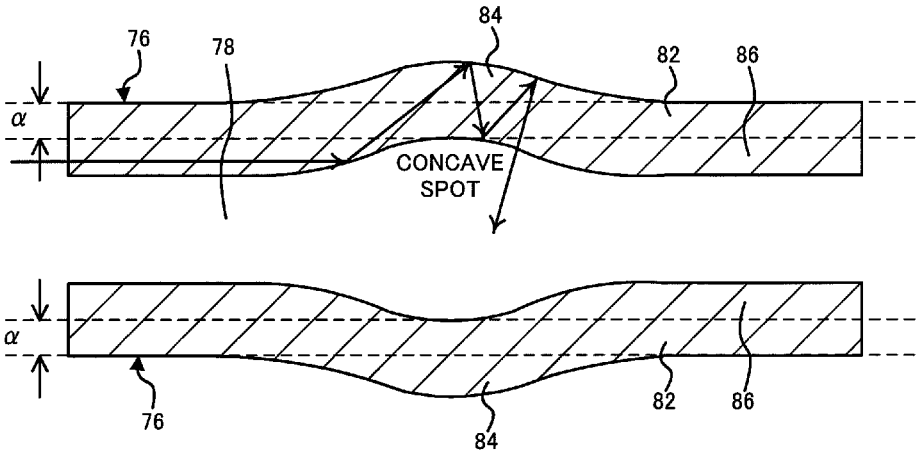
FIG. 13 is an enlarged view of a section surrounded by dotted lines in FIG. 12.

FIG. 13 is an enlarged view of a section surrounded by dotted lines in FIG. 12.

As shown in FIG. 12 and FIG. 13, the light irradiation element 68 includes a cavity 78 through which light emitted from the light emission member 70 passes in a direction intersecting the direction in which the image bearing body 40 turns, a translucent light conduit 76 surrounding at least a part of the cavity 78 and bordering the cavity 78, and a reflection member 72 to reflect light, provided in sides not facing the image bearing body 40.

More specifically, the light conduit 76 includes a cylindrical light conduit body 82 with a predetermined thickness $\alpha$, convex spots 84 on the outer circumference of the light conduit body 82, and convex spots 86 on the inner circumference of the light conduit body 82. There are plural convex spots 84, 86 along the direction intersecting the direction in which the image bearing body 40 turns. The convex spots 84, 86 may be formed generally annularly or formed helically along the outer circumference or the inner circumference. There are more convex spots 84, 86 in a portion including the other end than in a portion including the end for light to enter. That is, there are more convex spots 84, 86 near the termination section 74 which will be described later rather than near the opening 79.

Although the light conduit body 82, convex spots 84, and convex spots 86 have been described as separate components of the light conduit 76, the light conduit body 82, convex spots 84, and convex spots 86 may be formed integrally. For example, when the light conduit 76 is molded by extrusion molding or drawing molding, the conduit may be formed to have a partially wavy shape with a variation in the outside diameter and the inside diameter by changing the drawing speed or extrusion speed or applying vibration.

Accordingly, as indicated by arrows in FIG. 12, light emitted from the light emission member 70 passes through the cavity 78 or the inside of the light conduit 76 of the light irradiation element 68 and is reflected and diffused by at least any of the light conduit body 82, the interfacial surfaces of the convex spots 84, 86, and the reflection member 72 of the light conduit 76, and irradiates the image bearing body 40.

Here, as indicated by the arrows in FIG. 12, for light passing through the cavity 78 and reflected by a concave spot between convex spots 86, some stays near the concave spot and some is reflected backward toward the light emission member 70. Because of light reflection occurring in this way, the amount of reflected light increases. Likewise, for light passing through the light conduit 76 and reflected by the inner surface of the light conduit 76 in a convex spot 84, which is, however, not shown, some stays on the inner surface of the light conduit 76 in the convex spot 84 and some is reflected backward toward the light emission member 70, and consequently the amount of reflected light increases.

Furthermore, as indicated by arrows in FIG. 13, near a convex spot 84, the inner surface of the light conduit 76 in a concave spot between convex spots 86 is convex when viewed from the inside of the light conduit 76. In this section, the passage of the light conduit 76 bulges because of this convex and the convex spot 84. Thereby, more light stays here and the amount of reflected light increases. Thus, the amount of reflected light builds up by some of light reflected by a concave spot between convex spots 86, some of light reflected by the inner surface of the light conduit 76 in a convex spot 84, and light staying in a bulge portion of the passage of the light conduit 76.

Figure 14A:
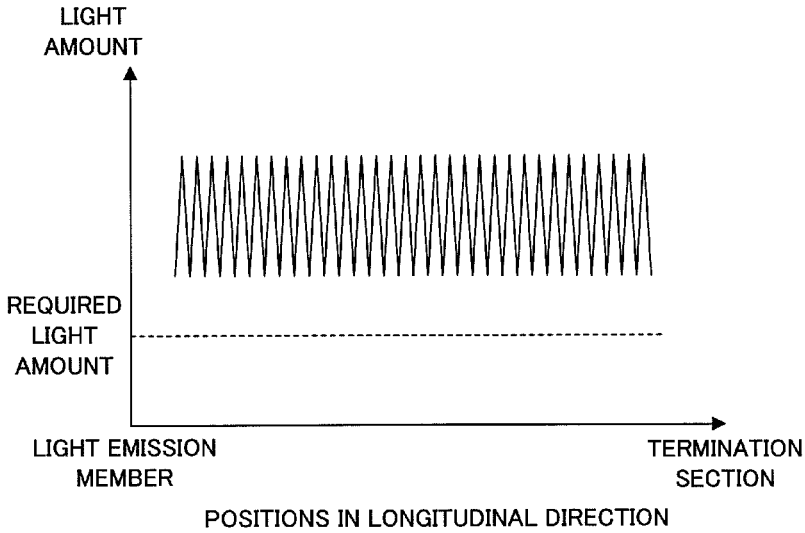
FIGS. 14A and 14B are graphs that represents a relationship between the amount of light irradiating the image bearing body 40 and the distance from the light emission member 70.
Figure 14B:
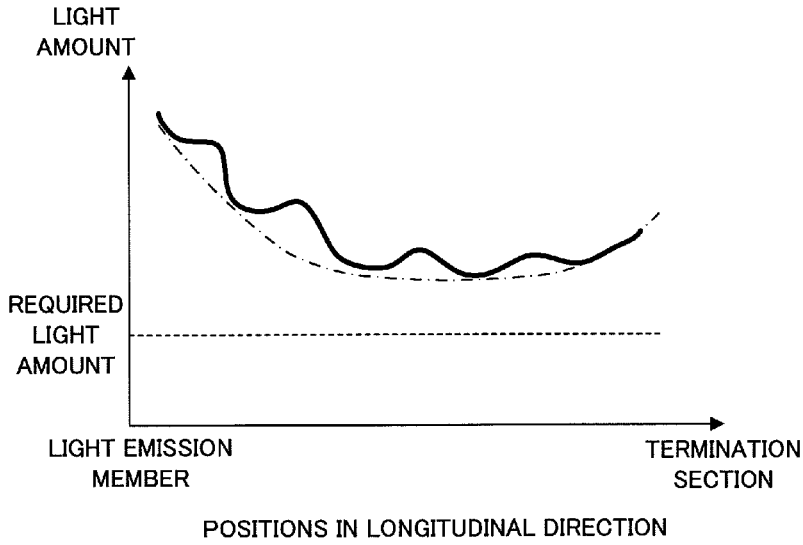

FIGS. 14A and 14B are graphs that represent a relationship between the amount of light irradiating the image bearing body 40 and the distance from the light emission member 70.

FIG. 14A is the same as FIG. 6A. FIG. 14B shows a relationship between the amount of light irradiating the image bearing body 40 and the distance from the light emission member 70 in the case of using the light irradiation element 68 of the present exemplary embodiment. In FIG. 14B, a solid line shows the above relationship for the light irradiation element 68 of the present exemplary embodiment and a dashed line shows the above relationship for alight conduit without the convex spots 84, 86. As shown in FIG. 14B, the light irradiation element 68 of the present exemplary embodiment has smaller attenuation in the light amount than a light conduit without the convex spots 84, 86.

Then, the image forming apparatus 10 is described with regard to fourteenth through seventeenth exemplary embodiments. In the fourteenth through seventeenth exemplary embodiments of the image forming apparatus 10, various forms of light irradiation elements 68 are used.

Figure 15:
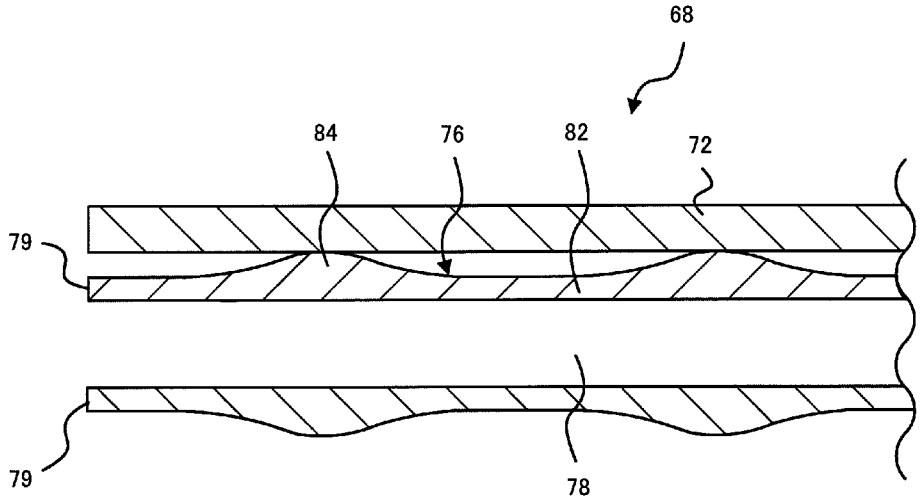
FIG. 15 shows a side cross section of the light irradiation element 68 according to a fourteenth exemplary embodiment.

FIG. 15 shows a side cross section of a light irradiation element 68 according to a fourteenth exemplary embodiment of the invention.

As shown in FIG. 15, the light irradiation element 68 of the present exemplary embodiment includes a light conduit 76 in which the light conduit body 82 is only provided with convex spots 84. That is, convex spots 86 are not provided. Due to this, the outside of the light conduit 76 has a concavo-convex configuration along the longitudinal direction.

Figure 16:
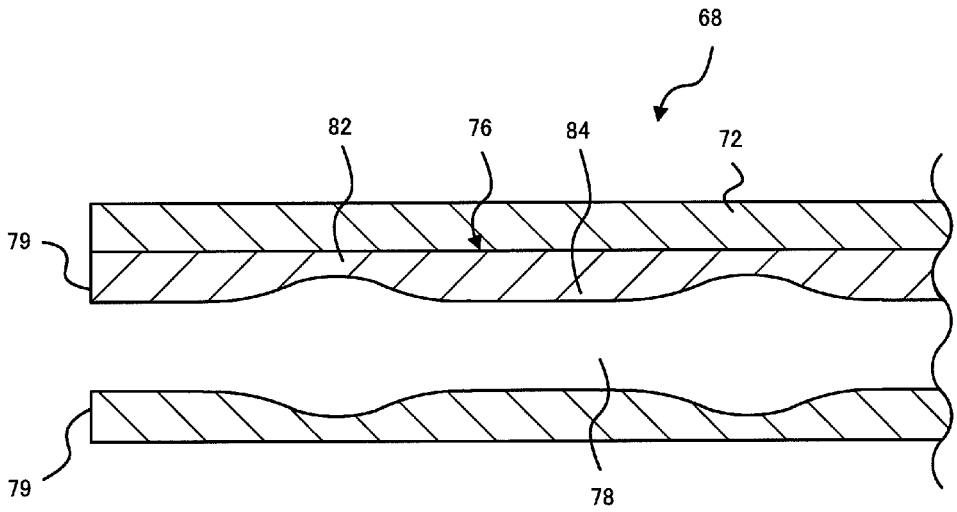
FIG. 16 shows a side cross section of the light irradiation element 68 according to a fifteenth exemplary embodiment.

FIG. 16 shows a side cross section of a light irradiation element 68 according to a fifteenth exemplary embodiment of the invention.

As shown in FIG. 16, the light irradiation element 68 of the present exemplary embodiment includes a light conduit 76 in which the light conduit body 82 is only provided with convex spots 86. That is, convex spots 84 are not provided. Due to this, the inside of the light conduit 76 has a concavo-convex configuration along the longitudinal direction.

Figure 17:
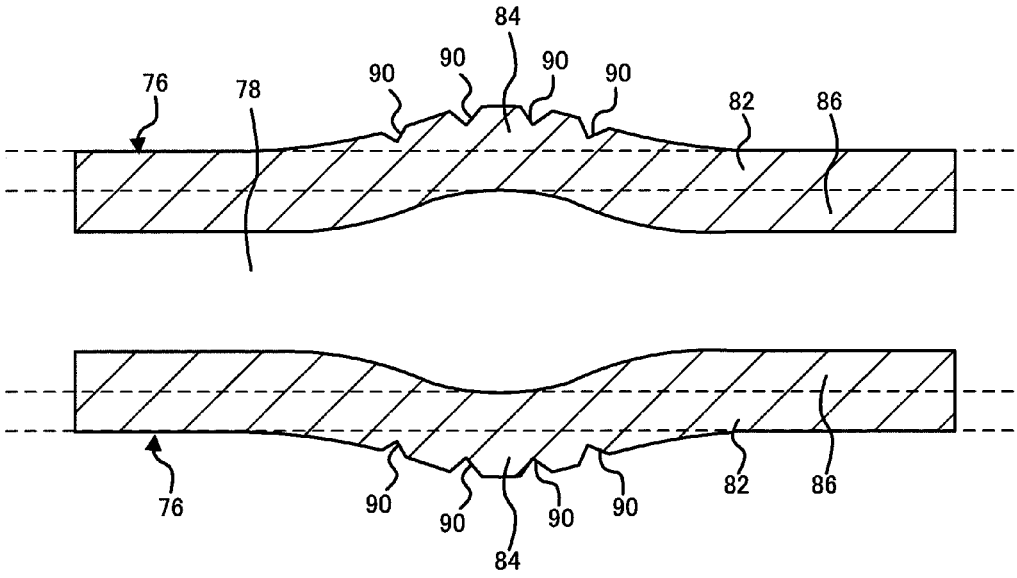
FIG. 17 is an enlarged view of a part of a side cross section of the light irradiation element 68 according to a sixteenth exemplary embodiment.

FIG. 17 is an enlarged view of a part of a side cross section of a light irradiation element 68 according to a sixteenth exemplary embodiment of the invention.

As shown in FIG. 17, the light irradiation element 68 of the present exemplary embodiment includes a light conduit 76 in which a convex spot 84 is provided with reflecting grooves 90. That is, the outside of the light conduit 76 is provided with the reflecting grooves 90. The reflecting grooves 90 are made along the direction intersecting the longitudinal direction of the light conduit 76. The reflecting grooves 90 may be made generally annularly or made helically. Plural reflecting grooves 90 are made. In particular, there are more grooves in the upper part of the convex spot 84. Depth of the reflecting grooves 90 is a value to an extent that the grooves do not reach the light conduit body 82.

The reflecting grooves 90 may be provided in the light irradiation element 68 (FIG. 15) according to the fourteenth exemplary embodiment. Although the reflecting grooves 90 are visibly notched to a depth in FIG. 17, they may be so fine as to be invisible. For example, the reflecting grooves 90 may be made by filing down the outside surface or by rolling the light irradiation element 68 on a rough surface.

Figure 18:
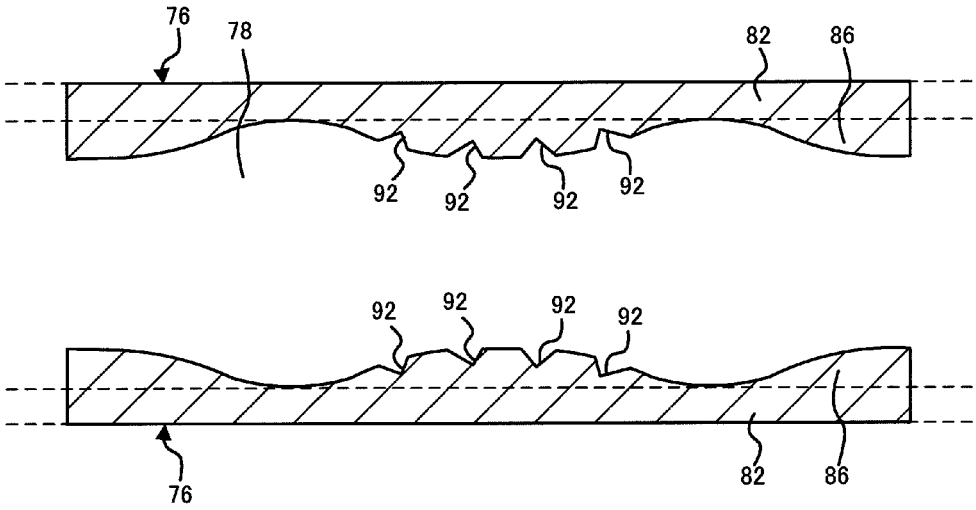
FIG. 18 is an enlarged view of a part of a side cross section of the light irradiation element 68 according to a seventeenth exemplary embodiment.

FIG. 18 is an enlarged view of a part of a side cross section of a light irradiation element 68 according to a seventeenth exemplary embodiment of the invention.

As shown in FIG. 18, the light irradiation element 68 of the present exemplary embodiment includes a light conduit 76 in which a convex spot 86 is provided with reflecting grooves 92. That is, the inside of the light conduit 76 is provided with the reflecting grooves 92. The reflecting grooves 92 are made along the direction intersecting the longitudinal direction of the light conduit 76. The reflecting grooves 92 may be made generally annularly or made helically. Plural reflecting grooves 92 are made. In particular, there are more grooves in the upper part of the convex spot 86. Depth of the reflecting grooves 90 is a value to an extent that the grooves do not reach the light conduit body 82. The reflecting grooves 90 may be provided in the light irradiation element 68 (FIG. 13) according to the thirteenth exemplary embodiment and the light irradiation element 68 (FIG. 17) according to the sixteenth exemplary embodiment.

Then, the image forming apparatus 10 is described with regard to eighteenth and nineteenth exemplary embodiments. In the eighteenth and nineteenth exemplary embodiments of the image forming apparatus 10, a light irradiation element 68 includes a reflection member 72 having a light reflecting surface 98 made of a metal film as its inner wall.

Figure 19:
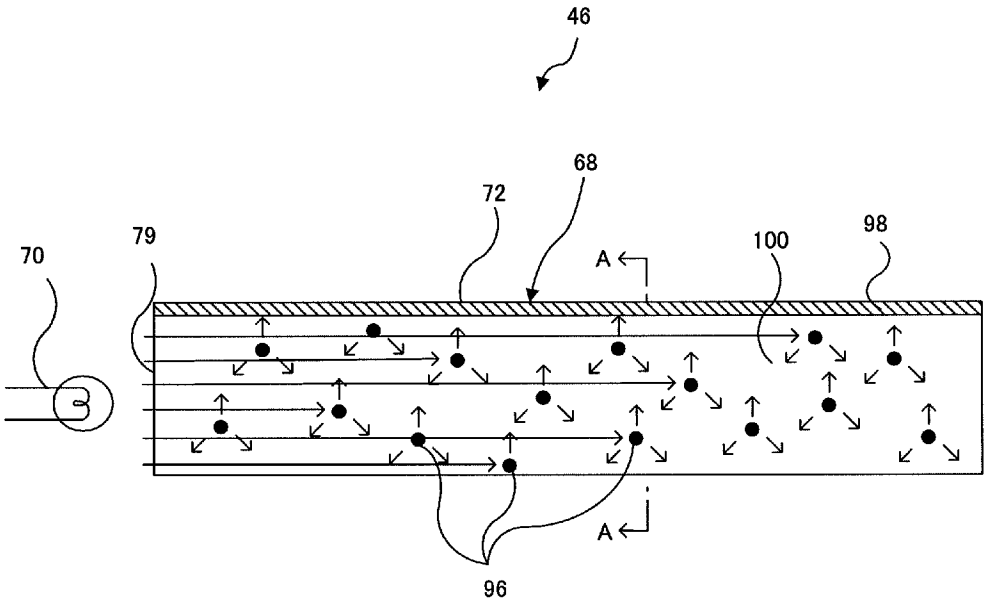
FIG. 19 depicts an optical charge-erasing device 46, focusing on the side cross section of the light irradiation element 68 according to an eighteenth exemplary embodiment.

FIG. 19 depicts an optical charge-erasing device 46, focusing on the side cross section of a light irradiation element 68 according to an eighteenth exemplary embodiment.

Figure 20:
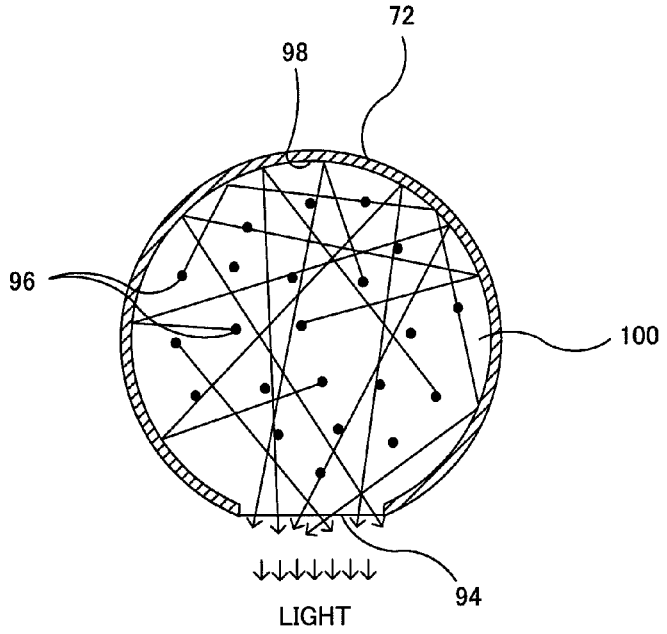
FIG. 20 shows an A-A cross section of the light irradiation element 68 according to the eighteenth exemplary embodiment used in the image forming apparatus.

FIG. 20 shows an A-A cross section of the light irradiation element 68 according to the eighteenth exemplary embodiment used in the image forming apparatus.

As shown in FIG. 19 and FIG. 20, in the reflection member 72 of the light irradiation element 68, a light reflecting surface 98 is formed as the inner wall made of a thin metal film with light reflectivity. The inner wall that is the light reflecting surface 98 covers all over the inside of light irradiation element 68 except for a light outlet 94 so that incident light from the opening 79 does not leak out from any part other than the light outlet 94. In the middle of the light irradiation element 68 in an axial direction, a light guide passage 100 (light guide passage body) is formed as a cylindrical structure. The light guide passage 100 is formed from a highly translucent material such as, e.g., methacrylic resin, polycarbonate resin, cyclic olefin resin, or glass.

Inside the resin that forms the light guide passage 100, light diffusive particles 96 having light diffusivity such as aluminum trioxide and titanium dioxide are dispersed evenly.

By configuring the light irradiation element 68 in this way, the light irradiation element 68 takes in light from the light emission member 70 through the opening 79 and allows the light to travel in a straight line through the light guide passage 100. The light irradiation element 68 converts the light traveling in a straight line into light to travel in different directions by making the light reflected by the light diffusive particles 96 dispersed in the light guide passage 100. This light is reflected by the light reflecting surface 98 covering the inside wall of the reflection member 72 and light to travel in more different directions is produced. By emitting light dispersed in diverse directions from the light outlet 94 toward the image bearing body 40, removing charges from the image bearing body 40 is performed with a uniform amount of light.

The light reflecting surface 98 may be provided as described below. To obtain a sufficient amount of reflected light from the light reflecting surface 98, the reflectivity of the light reflecting surface 98 may be 40% or higher. By setting the reflectivity at 40% or higher, it can be avoided that the amount of light across the light guide passage 100 becomes nonuniform, as the light amount is larger near the light incident end, whereas the light amount decreases as the light travels and comes nearer to the opposite end. Uniform light irradiation can be accomplished for the image bearing body 40 with the length of the axis (about 300 mm) for A3 size.

The light reflecting surface 98 may be produced by forming a thin metal film of aluminum or the like on the inner wall of the reflection member 72 of the light irradiation element 68 by a vacuum deposition method. Alternatively, the light reflecting surface 98 may be produced as a thin metal film directly printed on the inner wall of the reflection member 72 of the light irradiation element 68 by screen printing or hot offset printing. The light reflecting surface 98 may be produced as a seal member having light reflectivity covered on the inner surface of the reflection member 72. Furthermore, to provide reflectivity, for example, the reflection member itself may be made of a metal material with reflectivity. In short, the wall surface may have light reflectivity and there is no limitation on its material, manufacturing method, etc.

Then, the light diffusive particles 96 may be provided as described below. The refraction factor of the light diffusive particles 96 used in the present exemplary embodiment may be 1.7 to 1.8 for aluminum trioxide. If the refraction factor is less than 1.7, light scattering is so small that light traveling in a straight line is unhampered and reaches the other end opposite to the opening 79. It is hard to alter this light to that directed to face the image bearing body 40. Conversely, if the refraction factor exceeds 3.0, light scattering is too large. Excessive light scattering occurs near the opening 79, whereas a sufficient amount of light is not transmitted to the end opposite to the opening 79, and the amount of light is liable to be uneven. While the refraction factor of the light diffusive particles 96 is specified as 1.7 to 1.8 in the present example, it may be 1.7 to 2.0 or 1.7 to 2.5. Even with 1.7 to 3.0, a desired effect can be obtained.

The average particle size of these particles may be 0.01 to 1.0 μm. If the average particle size exceeds 1.0 μm, reflected light in the axial direction of the light guide passage 100 increases to block the light traveling in a straight line from the opening 79. This results in loss in the total amount of light, which is undesirable. If the average particle size is less than 0.01 μm, incident light cannot be scattered and the intended role of light diffusion is hard to fulfill.

Furthermore, the quantity of the particles may be 1 to 200 ppm relative to the weight of the resin. If this quantity is less than 1 ppm, the proportion of light reflected by the light diffusive particles 96, while traveling in a straight line from the opening 79, is too small. This makes it difficult to obtain the effect of light diffusion. Conversely, when the quantity of the particles exceeds 200 ppm, most of incident light from the opening 79 only scatters near the opening 79. This may prevent a sufficient amount of light from reaching a point near the opposite end from the middle of the light guide passage 100.

Although an appropriate proportion of the particles in the resin weight is specified as 1 to 200 ppm in the above description, the particles throughout the passage do not need to exist at an equal proportion. In the light guide passage 100, the particles may exist, for example, at a rate of 1 to 10 ppm near the opening 79, at a rate of 5 to 40 ppm in the middle, and at a rate of 10 to 70 ppm near the end opposite to the opening 79. In this way, by setting the quantity of the particles adaptive to increase/decrease in the amount of light depending on distance from the opening 79, a uniform amount of light can be obtained throughout the light guide passage 100.

The shape of the particles may be completely spherical, spherical, scale-like, cubic, or in an indeterminate form. The particle shape may be any combination of diverse shapes and is not restrictive. Further, although aluminum trioxide and titanium dioxide have already been mentioned as the light diffusive particles used in the present exemplary embodiment, any particles that meet the conditions described above may be used, not restricted to the above-mentioned ones.

In this way, light from the light emission member 70 travels in a straight line from the opening 79 through the light guide passage 100 in the axial direction of the light irradiation element 68 and the light is reflected in diverse directions by the light diffusive particles 96 dispersed in the passage. This light is also reflected by the light reflecting surface 98 covering the inner wall of the reflection member 72 and this creates more even scattering of the light, with the result that the amount of light becomes uniform anywhere in the passage. The light is emitted from the light outlet 94 and irradiates the image bearing body 40. Thereby, sufficient removal of charges can be performed, avoiding that the charge removal effect varies with position on the image bearing body.

Figure 21:
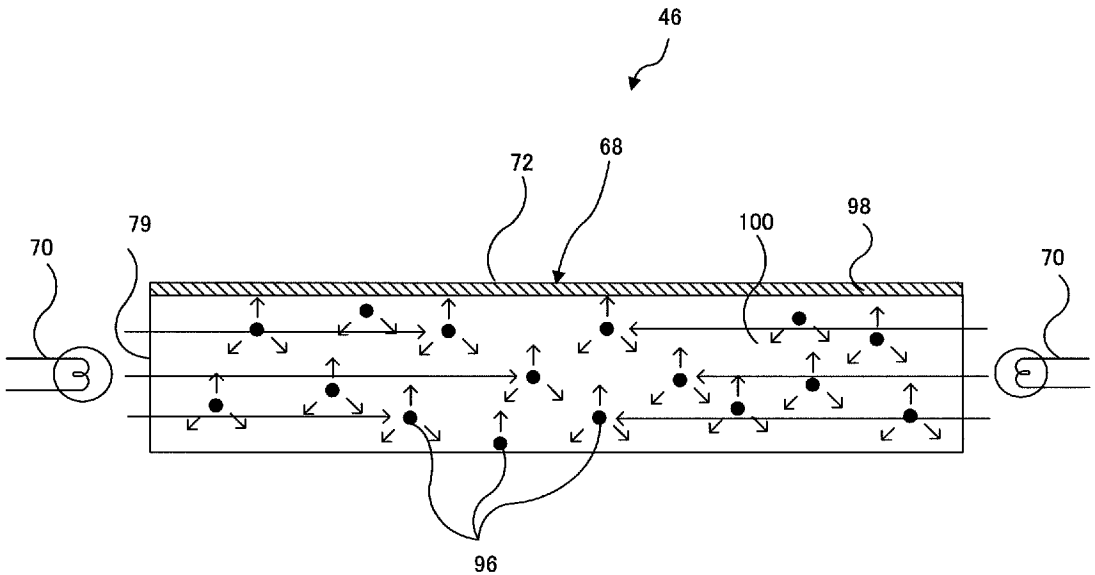
FIG. 21 depicts an optical charge-erasing device 46, focusing on the side cross section of the light irradiation element 68 according to an nineteenth exemplary embodiment.

FIG. 21 depicts an optical charge-erasing device 46, focusing on the side cross section of a light irradiation element 68 according to a nineteenth exemplary embodiment.

As shown in FIG. 21, in the image forming apparatus 10 of the present exemplary embodiment, both ends of the light irradiation element 68 are open and light emission members 70 are provided beside both ends of the light irradiation element 68. Thereby, the proportion of the light diffusive particles 96 relative to the resin weight can be reduced by half. Incident light enters the light guide passage 100 from both ends and this can provide more uniform light and a sufficient amount of light. It is thus possible to avoid deficient removal of charges due to an insufficient amount of light. By provision of the light emission members 70 beside both ends of the light irradiation element 68, a sufficient amount of light can be gained even with reduction by half in the amount of incident light at each end.

Figure 22:
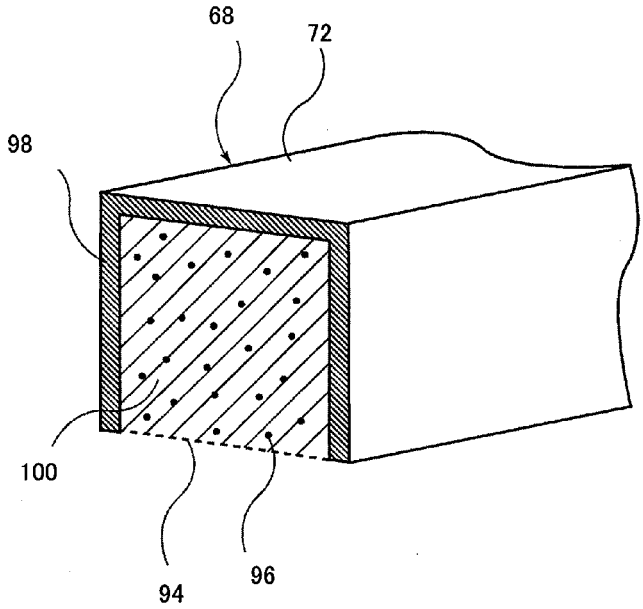
FIG. 22 shows a cross section of a light irradiation element formed in an alternative shape.
Figure 23:
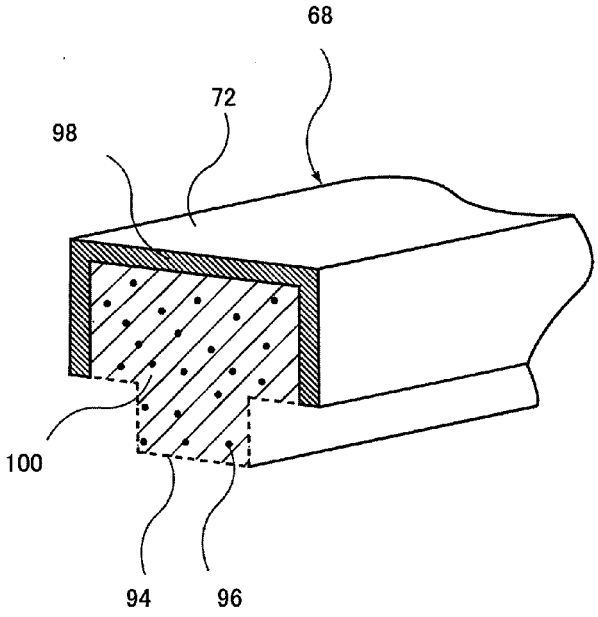
FIG. 23 shows a cross section of a light irradiation element formed in an alternative shape.

Since the light diffusive particles cause light scattering in diverse directions, the shape of the light irradiation element 68 may not be cylindrical in the axial direction of the image bearing body. For example, as shown in FIG. 22, the light irradiation element 68 may be formed in the shape of a rectangular solid. Alternatively, as shown in FIG. 23, the light irradiation element 68 may be formed in the shape of convex quadrilateral with the region of the light outlet 94 being narrowed. In the latter case, because the angle of light emission can be wider, the time of light irradiation onto the image bearing body 40 becomes longer than otherwise and more sufficient removal of charges can be performed. Thus, the shape of the light irradiation element 68 can be diversified and the degree of freedom in design increases, for example, installing the light irradiation element 68 closer to the image bearing body than ever before.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A light irradiation element comprising:

a cavity through which light passes; and a translucent light conduit surrounding at least a part of the cavity, provided with convex spots reflecting some of the light passing therethrough, the translucent light conduit formed with an exterior portion and an interior hollow portion, the cavity being defined by the interior hollow portion, the light irradiation element being disposed along a longitudinal direction of an image bearing body on which an electrostatic latent image is formed and directing the light passed through the light conduit to irradiate the image bearing body.

2. The light irradiation element of claim 1, wherein a plurality of convex spots are provided in a direction intersecting a direction in which the rotating image bearing body turns.

3. The light irradiation element of claim 1, wherein the light conduit is cylindrical, and the convex spots are provided on an outer circumstance of the light conduit.

4. The light irradiation element of claim 1, wherein the light conduit is cylindrical, and the convex spots are provided on an inner circumstance of the light conduit.

5. The light irradiation element of claim 1, wherein there are more convex spots near an end rather than near another end from which light enters.

6. The light irradiation element of claim 1, wherein the convex spots are provided with reflecting grooves along a direction intersecting the longitudinal direction of the light conduit.

7. The light irradiation element of claim 6, wherein there are more reflecting grooves in an upper part of the convex spot.

8. The light irradiation element of claim 1, wherein the light conduit is made from any of the following: acrylic resin, polycarbonate resin, polyethylene resin, and ABS resin.

9. The light irradiation element of claim 1, further comprising a reflection member for reflecting light, provided on sides not facing the image bearing body.

10. The light irradiation element of claim 9, wherein the reflection member has protrusions that protrude into an opening that faces the image bearing body.

* * * * *